United States Patent [19]

De Ridder et al.

[11] 3,990,920

[45] Nov. 9, 1976

[54] METAL TREATING COMPOSITIONS OF ADJUSTED PH

[75] Inventors: Jon A. De Ridder, Ashtabula; Alexander W. Kennedy, Chardon; Walter H. Gunn, Painesville, all of Ohio

[73] Assignee: Diamond Shamrock Corporation, Cleveland, Ohio

[22] Filed: Apr. 10, 1975

[21] Appl. No.: 566,754

Related U.S. Application Data

[63] Continuation-in-part of Ser. No. 467,132, May 6, 1974, abandoned, which is a continuation-in-part of Ser. No. 298,665, Oct. 18, 1972, abandoned.

[52] U.S. Cl. ..... 148/6.2; 148/6.16; 106/14

[51] Int. Cl.[2] ..... C23F 7/26

[58] Field of Search ..... 148/6.2, 6.16; 106/14

[56] References Cited

UNITED STATES PATENTS

| | | | |
|---|---|---|---|
| 3,553,034 | 1/1971 | Harvey et al. | 148/6.2 |
| 3,671,331 | 6/1972 | Malken et al. | 148/6.2 |
| 3,687,738 | 8/1972 | Malken | 148/6.2 |
| 3,687,739 | 8/1972 | Kennedy et al. | 148/6.2 |
| 3,849,141 | 11/1974 | Palm et al. | 148/6.2 X |

*Primary Examiner*—Ralph S. Kendall
*Assistant Examiner*—Charles R. Wolfe, Jr.
*Attorney, Agent, or Firm*—John J. Freer

[57] ABSTRACT

Metal treating compositions, containing chromic acid and pulverulent zinc, and which find particular utility in the coating of metal substrates prior to painting, now exhibit extended bath stability through pH adjustment. The key to the adjustment is not in the final bath makeup. Rather, the adjustment is made during preparation of a precursor component containing chromic acid. Such component of adjusted pH may then be blended with additional composition ingredients including the pulverulent zinc to form a bath of excellent stability, e.g., extended freedom from gelation.

14 Claims, No Drawings

METAL TREATING COMPOSITIONS OF ADJUSTED PH

CROSS-REFERENCE TO RELATED APPLICATIONS

This application is a continuation-in-part of U.S. application Ser. No. 467,132, filed May 6, 1974, and now abandoned, which is in turn a continuation-in-part of U.S. application Ser. No. 298,665, filed Oct. 18, 1972, and now abandoned.

BACKGROUND OF THE INVENTION

It is not unusual in the formation of compositions containing chromic acid, or its equivalent, that are used in coating metal substrates, to bear in mind the pH of the coating composition. For example, in the chromate conversion coating art such may be the case since these coatings are ostensibly developed for application at least to aluminum surfaces where they will attack the surface during film formation. Such chromate conversion coatings therefor contain acidic substances to enhance the attack on a substrate metal; and they further contain substances such as those supplying fluoride ions that may be termed accelerators. Such ions thus augment film formation. In U.S. Pat. No. 3,113,051 a chromate conversion coating for aluminum surfaces has been disclosed and it is further taught therein that the coating composition should have a pH for best coating formulation of between about 1.3–2.2.

In other coating compositions containing chromic acid or its equivalent, but which are not of the nature of conversion coatings, pH may also be important. For example, in U.S. Pat. No. 3,630,789 a treating solution that can be free from ions such as fluoride ions and also strong acids for substrate metal attack, is nevertheless formulated for application to metal substrates. Further, it is formulated with careful control to maintain the treating solution pH between about 1.8–5 to prevent the reaction of composition ingredients before application, while maintaining a bath that will effectively treat base metals.

In chromic-acid-containing compositions, also containing reducing agent for the chromic acid, the presence of ammonia has been disclosed to have special usefulness. Thus, in U.S. Pat. No. 2,911,332, ammonia has been added, for example to improve corrosion resistance of subsequent coatings on tin-plated steel. After the addition of ammonia the resulting composition is ready for use, even though the coating bath pH may be slightly alkaline.

In the continuing development of the coating compositions that are treating solutions, and which may also be referred to as bonding compositions as in U.S. Pat. No. 3,382,081, one development includes formulation with pulverulent metal, especially pulverulent zinc. Thus, U.S. Pat. No. 3,671,331 discloses employing finely divided zinc most particularly in bonding coatings, i.e., compositions containing hexavalent chromium providing substance, such as chromic acid, and an agent for reducing the hexavalent chromium provided by the chromic acid. Further, U.S. Pat. No. 3,687,738 discloses the development of a coating composition that may contain, as principle ingredients, pulverulent zinc plus chromic acid. In the formulation of such compositions it would be most desirable to provide a coating composition having extended bath stability. In this regard it would be most especially desirable that such extended bath stability include freedom from gelation as this phenomenon is virtually irreversible.

SUMMARY OF THE INVENTION

It has now been found that such coating baths containing pulverulent metal, i.e., finely divided zinc, can be formulated to exhibit extended bath stability. Such extended bath stability is obtained through pH control of the coating composition. Surprisingly, the key to such pH control can not be left just to the overall pH control of the final coating composition, but rather must be initiated with control of a composition precursor constituent.

More particularly, the starting key to bath stability resides in pH control of the precursor constituent that contains the chromic acid and may also contain reducing agent for the hexavalent chromium provided by the chromic acid. It is also, however, necessary to provide for pH control of the final bath. In addition to augmented bath stability, pH control will provide for subsequent pre-paint coatings on metal substrates that afford enhanced adhesion for topcoats, and particularly under shear forces. Such force for the resulting composite coating may be typically met when coated metal work pieces proceed through continuous metal forming operations initiated by drawing or pressing and continuing on through a series of trimming, punching and bending steps.

In one aspect, the present invention is directed to the method of preparing a pulverulent-zinc-containing coating composition, having enhanced compositional stability at a pH below about 5.7 and above 4.0, which composition is adapted for treating metal substrates and providing corrosion resistance thereto. The coating composition is prepared to contain hexavalent chromium from a pulverulent-zinc-free chromic acid component (A), and to further contain zinc from a pulverulent zinc component (B). The method comprises first preparing the chromic acid component (A) at a pH of above 0.8 and not above about 5. This preparation of the chromic acid component (A) includes: establishing an aqueous composition containing chromic acid in aqueous solution, the chromic acid being present in amount sufficient to provide for a pH in water of below 0.8, then adjusting the pH of the aqueous composition to above 0.8 and not above about 5, with basic, compatible and acid soluble pH adjustment agent, wherein compatibility of the pH adjustment agent provides cured coatings from the coating composition of enhanced water insolubility. Then the method of preparing the coating composition is continued by preparing the pulverulent zinc component (B) to contain zinc in an amount sufficient to supply above about 50 grams per liter of pulverulent zinc to the coating composition; and then blending components together to prepare the coating composition of enhanced stability.

The present invention is also directed to a pre-paint coating composition component, as well as to the method of preparing corrosion resistant coated metal substrates having adherent pre-paint coatings. The invention is further directed to such coated metal substrates that are further topcoated as well as to metal articles thereby produced.

DESCRIPTION OF THE PREFERRED EMBODIMENTS

The precursor constituent, or "chromic acid component", for preparing the pre-paint coating composition has as a key ingredient the chromic acid. This supplies hexavalent chromium to the precursor constituent and it may also be supplied to the constituent by equivalents to chromic acid, for example, chromium trioxide or chromic acid anhydride. Although the chromic acid may be present in the precursor constituent in small amount, for example in an amount equivalent to about 10 grams of $CrO_3$ per liter, to provide for some dilution affect in preparing a coating composition from a precursor constituent, the chromic acid may be present in very substantially greater amounts, for example 200–500 grams of $CrO_3$ per liter of water. It may be desirable to formulate the precursor constituent in a location removed from its point of use. In such case, the aqueous medium portion of the constituent is typically minimized and very substantial amounts of chromic acid in the constituent are achieved. However, it is most typical to formulate a precursor composition, regardless of whether such constituent will be used at the point of formulation, or will be formulated and shipped prior to use, that contains between about 20–200 grams of chromic acid per liter. For a coating composition that would contain the key ingredients of chromic acid and pulverulent zinc, such as taught in U.S. Pat. No. 3,687,738, the simplistic precursor constituent could be free from agents for reducing the hexavalent chromium provided by the chromic acid. Otherwise, such constituent will generally further contain any such reducing agent as a principle ingredient.

In the prior art a very extensive number of substances have been shown to be capable of reducing hexavalent chromium, they are therefore taught to be useful in pre-paint coating compositions containing chromic acid and a reducing agent therefore. It is however contemplated in the present invention that the reducing agent or combination of reducing agents present in the precursor constituent be water soluble in major amounts and yet provide a subsequent pre-paint coating on a metal substrate that is water insoluble. Further, it is preferred for efficiency in the preparation and use of the precursor constituent that the reducing agent be completely water soluble. It is further most advantageous if the reducing agent exhibits suppressed action, or no reducing action towards the hexavalent chromium during formulation of the precursor constituent.

Although this is not a consideration when the chromic acid is present in the constituent in substantial amount, e.g., an amount equivalent to above about 20 grams per liter, when greater than about 20 grams of chromic acid per liter are present, a blend of the acid with the reducing agent will generally have a pH in water of below about 0.8, as the mole ratio of the $CrO_3$ to the reducing agent is generally on the order of 4 to 1 but may be greater. However, this ratio may be less, for example 0.8:1.

Although the use of any of a variety of reducing agents that can be present to reduce the hexavalent chromium is contemplated, it is preferred for efficiency and economy to use acidic reducing agents. Most especially these are succinic acid or the other dicarboxylic acids of up to 14 carbon atoms as have been disclosed in U.S. Pat. No. 3,382,081. Such acids with the exception of succinic acid may be used alone, or these acids can be used in mixture or in mixture with other organic substances exemplified by aspartic acid, acrylamide or succinimide. Additional useful combinations that are particularly contemplated are the combinations of mono-, tri- or polycarboxylic acids in combination with additional organic substances as has been taught in U.S. Pat. No. 3,519,501. Still further are the teachings in regard to reducing agents that may be acidic in nature and therefore especially useful in the present invention and have been disclosed in U.S. Pat. No. 3,535,166 and 3,535,167. These reducing agents will typically readily provide for solutions in water along with chromic acid that have a pH of below 0.8.

Substantially all of the pre-paint coating compositions, and thus substantially all of the precursor constituents, are simply water based ostensibly for economy. But for additional, or alternative substances to supply the liquid medium, there have been taught, as in U.S. Pat. No. 3,437,531, blends of chlorinated hydrocarbons and a tertiary alcohol including tertiary butyl alcohol as well as alcohols other than tertiary butyl alcohol. It would appear then in the selection of the liquid medium for the precursor constituent that economy is of major importance and thus such medium would most always contain readily commercially available liquids.

The final key component to the precursor constituent is the inorganic pH adjustment agent. Such agent should be basic, and by this it is meant that the agent will yield a solution pH above 7.0 when the agent is dissolved in water alone. Also such agent should have sufficient water solubility in the aqueous chromic acid solution of the precursor constituent i.e., be acid soluble, so as to provide for the necessary pH adjustment. This is more fully demonstrated hereinafter in connection with the examples through the use of aluminum hydroxide and strontium oxide. Compatibility of the agents, although it can include the foregoing characteristics, is also based upon the pH adjusting agent providing for final coatings, after application of the pre-paint coating composition to a metal substrate and curing, which subsequent coatings are water insoluble. This is also more fully developed hereinbelow in connection with the examples, as for example with ammonium hydroxide. This substance, although taught in the prior art to be useful for simplified coating compositions, as mentioned hereinbefore, will not perform satisfactorily in the more detailed coating baths that are prepared from the precursor constituents of the present invention.

An additional characteristic determining compatability of the agent is that it be essentially chemically inert towards the chromic acid, i.e., that it behave in solution in the precursor constituent in a manner to not deleteriously reduce the hexavalent chromium provided by the chromic acid. The reduction of the hexavalent chromium should thus be essentially or completely the function of the reducing agent. It is however contemplated to use compatible reducing agents that may have minor effect in regard to reduction of the hexavalent chromium so long as such effect can be compensated by providing sufficient chromic acid in the precursor constituent for subsequent action with the reducing agent. For example, sufficiency might be judged by providing a mole ratio of $CrO_3$ to the reducing agent after pH adjustment of above about 0.5:1, or such other ratio as will achieve desirable coating characteristics, e.g., corrosion resistance and water insolubility. Demonstration of this characteristic has been more fully dealt with in the examples in connection with the compound strontium oxide.

Representative compatible pH adjusting agents are the inorganic metallic oxide, carbonate and hydroxide of lithium. The higher metals in Group 1A, i.e., sodium and potassium, can be initially adequate for pH adjustment. However, the subsequent coatings on metal substrates have been found to be water soluble and thus such agents are not suitable as compatible pH adjusting agents. Other metal oxides, carbonates and hydroxides that are however compatible can be supplied by metals in Group IIA, e.g., calcium oxide or calcium carbonate, or metals in groups above IIA, i.e., to the right of the IIA Group in the periodic table, such as zinc oxide as a representative of Group IIB. So long as such substances have compatibility, they are regarded as suitable pH adjusting agents. Although representative pH adjusting agents in addition to those already mentioned include calcium hydroxide, magnesium oxide, and strontium oxide, the above mentioned zinc oxide is especially preferred for efficiency.

Although the agent may be blended into the precursor constituent to provide for an adjusted pH of the constituent of above 0.8 and not above about 5, and for subsequent coating compositions of best extended stability, such agent is advantageously used in amount to provide for a constituent pH of between about 1–3. Such amount will of course depend upon the concentration of the chromic acid in the precursor constituent, and additionally, for example, on the concentration of reducing agent and on the neutralizing strength of the pH adjustment agent. It is thus most practicable to consider the final precursor constituted pH for considering the amount of pH adjustment agent to be added.

Upon formulation of the precursor constituent with its appropriate ingredients and appropriate pH, such is then ready for blending with additional pre-paint coating composition substances. These include the finely divided zinc which, as mentioned above, will have some oxide content. It is neither commercially feasible, nor practicable, to obtain finely divided zinc that has virtually no oxide content. The pulverulent zinc may contain oxide in as much as 12–15 weight percent oxide or more, basis total weight of the zinc. It is, however, more typical that the zinc have an oxide content of less than 10 percent, for example, 3–5 weight percent. So long as the precursor constituent is appropriately prepared in accordance with the present invention, the oxide content of the zinc can have this great variation and generally not form undesirable pre-paint coating compositions.

As will be recognized by those skilled in the art, the particulate zinc will contain very minor amounts of other ingredients. Exemplary of such other materials are about 0.2% or less of lead and iron and about 0.1 weight percent of cadmium. In pre-paint coating composition of the prior art it has been contemplated to employ blends of pulverulent metals, as disclosed for example in U.S. Pat. No. 3,687,738. Thus it is contemplated in the present invention that the pulverulent zinc may actually be a pulverulent metallic blend, e.g., containing up to 20 weight percent or more of pulverulent aluminum with a balance of particulate zinc.

The pulverulent zinc component of the pre-paint coating composition can be such as contains finely-divided zinc pre-blended with additional substances. For example, it has already been shown in U.S. Pat. No. 3,318,716 to form an admix of aluminum flake, a polymeric glycol plus wetting agent. By essentially substituting particulate zinc for the aluminum, a suitable pulverulent zinc component, or "admix", may be formulated for blending the particulate zinc with, for example, a water-dispersible organic liquid and thickening agent. The admix may also contain substances such as dispersing agents, defoaming agents and the like. Such an admix may be prepared with an organic liquid such as diethylene glycol and a thickening agent such as hydroxyethyl cellulose, with serviceable additional thickeners including heteropolysaccharides. Such admixes can also be water based and these may further contain a water-dispersible organic liquid and/or surface active agents in the admix composition. Typically, such admixes have between about 0.1–3 weight percent of thickener, basis weight of the admix exclusive of liquid medium. Where a water dispersible organic liquid is employed in the admix it is typical to have a weight ratio of the particulate zinc to organic liquid from about 1:4 to about 4:1. These admixes may be readily blended into the pre-paint coating composition precursor constituent to prepare a composition ready for application.

The zinc component should contain sufficient zinc to provide the coating composition with at least about 50 grams per liter of the pulverulent zinc. Following composition preparation, there should be sufficient of the chromic acid component to provide in the coating composition a weight ratio of chromium, expressed as $CrO_3$, to pulverulent metal of not substantially less than about 0.08:1. A ratio of less than this may not provide sufficient chromium in the subsequent coating to achieve augmented bonding of the pulverulent metal to the metal substrate. On the other hand, a ratio of greater than about 0.4:1 may detract from the most enhanced corrosion resistance for the coated substrate. Thus, for an exemplary composition containing about 200 grams per liter of zinc, chromium should be supplied in an amount sufficient to provide in the coating composition an amount of chromium between about 15–80 grams per liter of coating composition.

When the coating composition is finally prepared upon the blending of components, it is important that the resulting composition have a pH of less than about 5.7, but above 4.0 for extended bath stability, e.g., suppressed composition gelation. As mentioned hereinabove, this control of composition pH must be arrived at during preparation of the chromic acid component. This achieves, for example, the most desirable characteristics in the applied coatings from the composition. The components, after preparation and without further operation, may well be harmonized in regard to their pH affect. In such case, coating composition pH and/or stability is sufficient to determine the pH affect of the components on the composition. Often however, attention is advisable to such pH affect when operating beyond typical parameters, e.g., when operating at substantially more than 200 grams per liter of zinc for the coating composition, and especially with a high oxide content zinc.

To then harmonize the pH affect of the components, the pH of the chromic acid component is directly determined. Also, the oxide content of the particulate zinc of the zinc component is determined. This oxide content determination may be done directly by standard method of determination, or such information is ostensibly always available from the manufacturer of the particulate zinc. The oxide content of the zinc, i.e., the suitability of the particulate zinc for pH affect on the coating composition, also may be determined indirectly, by trial preparation of a coating composition sample. In the indirect method, all coating composition components are blended together to prepare the coating composition sample. Following this, bath pH is measured and bath stability is observed for the composition sample, and undesirable bath gelation can call for assistance in harmonizing the pH affect of the components. Such harmonization of pH affect can be assisted or augmented, for example, by acidifying the coating composition during preparation. In this adjustment, the addition of chromic acid directly during component blending is preferred. However, the addition of other acidic substances is contemplated, e.g., molybdic acid and vanadic acid.

After coating composition preparation, such may be applied to the metal substrate by any conventional method for coating a substrate with a liquid, for example, dip coating, roller coating, or reverse roller coat, curtain coating, airless spray, rotary brush coating, pressure spray, or combination of such techniques as for example, spray and brush techniques. In any method, such application generally provides a pre-paint coating on the metal substrate supplying anywhere from about 20 to about 5,000 milligrams per square foot or coated substrate of the pulverulent zinc. Such amount can depend upon the substrate to be coated, the number of coatings to be applied, the end use contemplated and whether or not a topcoating is contemplated.

After application the pre-paint coating is cured, which can often be preceded simply by air drying at room temperature or by accelerated air drying at an elevated temperature such as 200° F or higher. Such curing, as by baking, provides for the water insoluble coating on the metal substrate. Baking at an elevated substrate temperature may be attained by preheating the metal prior to application of the pre-paint coating composition with, in any event, such curing temperatures not often exceeding temperature within a range of about 450°–1,000° F, although more moderate curving temperatures, e.g., 275°–325° F are contemplated when a topcoating will be applied and subsequently baked. At the more elevated curing temperatures the heating can be carried out in a fraction of a second but it is generally conducted for slightly longer time, such as about one minute, at a more reduced temperature.

In general, although the nature of the topcoat to be applied over the pre-paint coating is very broad in contemplation, topcoatings of a special interest are those that contain finely divided pulverulent material. Of these topcoatings, although finely divided pigment and fillers are important, topcoatings of special importance for enhancing corrosion protection of the underlying substrate contain pulverulent metals such as pulverulent zinc. For example, it has already been shown in U.S. Pat. No. 3,671,331, that a primer topcoating containing a particulate, electrically conductive pigment, such as zinc, is highly serviceable for a metal substrate that is first treated with a bonding coat composition containing a pulverulent metal such as finely divided zinc, which zinc was supplied in a pre-paint coating from a composition containing hexavalent-chromium-providing substance, such as chromic acid, and a reducing agent for said substance.

Such topcoatings, which are representative of those that contain pulverulent metal, are often for convenience referred to as "weldable primers". These primers contain an electrically conductive pigment plus a binder in a vehicle. Thus, it has been disclosed in U.S. Pat. No. 3,110,691 that a suitable zinc base paint composition for application to a metallic surface prior to welding can be prepared where key ingredients include not only the particulate zinc but also a liquid vehicle including a resinous film forming binder such as epoxy resin. Likewise, U.S. Pat. No. 3,118,048 shows a coating composition, that may be applied prior to welding, and has as chief ingredients a solvent forming at least a portion of the liquid vehicle and further containing a synthetic resin film-forming, or binder, component, of which modified alkyd resins are exemplary. In general, the particulate electrically conductive pigments in the weldable primers are aluminum, copper, cadmium, steel, carbon, zinc or magnetite, i.e., the magnetic oxide of iron, and these primers of particular interest include such pigments of larger size than the particulate zinc in the pre-paint coating. Also, the binder components may include polystyrene, chlorinated or isomerized rubber, polyvinyl acetate and polyvinyl chloride-polyvinyl acetate copolymers, alkyd/melamine, and epoxy resin.

A topcoating formulation applicable to metal substrates, without weldability in mind, contains particulate zinc along with zinc oxide. Such paints are often formulated with a zinc dust to zinc oxide ratio of about 4:1, although such ratio may be as high as 9:1. Total pigment concentrations will vary considerably and are typically dependent upon the ratio of the zinc to the zinc oxide. Also, the ingredients in the topcoating formulation will typically be dependent upon the zinc to zinc oxide ratio. For example, where such ratio is 4:1 the vehicle usually employed is linseed oil or other oleoresinous medium. At-ratios greater than 4 to 1, and with pigment concentrations ranging up to 90 to 95%, such compositions typically include polystyrene plasticized with chlorinated diphenyls.

Another topcoating system of special consideration has been referred to in the prior art, most ostensibly for convenience, as "silicate coatings". These appear to be aqueous systems that contain a finely divided metal such as powdered zinc or aluminum, lead, titanium or iron plus a water soluble or water dispersible binder. Representative of the binders are alkali metal silicates, an organic silicate ester, or a colloidal silica sol. Thus, U.S. Pat. No. 3,372,038 shows an aqueous coating system for providing corrosion resistance to metal substrates with a formulation containing a finely divided zinc powder plus an organic ammonium silicate. Although such silicate coatings are not typically employed before welding, U.S. Pat. No. 3,469,071 discloses arc-welding of a steel having a protective coating that may be derived from a coating composition containing inert silicate fillers, zinc powder and partially hydrolized esters of amphoteric metal binders, for example ethyl silicate. In U.S. Pat. No. 2,944,919 an aqueous based coating composition that contains a sodium silicate may further contain a finely divided metal in addition to zinc, such as magnesium, aluminum, manganese and titanium.

Although in the considerations for a topcoating over the pre-painted metal surface, such above discussed topcoatings are of special interest, the metal substrate can be further topcoated typically with any suitable paint, i.e., paint, primer, enamel, varnish or lacquer. Such paints may contain pigment in a binder or can be unpigmented as exemplified by cellulose lacquers, rosin varnishes, and oleoresinous varnishes. The paints can be solvent reduced or may be water reduced, e.g., latex or water soluble resins, including modified or soluble alkyds, or the paints can have reactive solvents such as in the polyesters or polyurethanes.

Particularly when the metal substrate to be coated is a weldable metal substrate, additional composite coating systems may be contemplated. For example, after the pre-paint coating composition of the present invention is applied to a weldable metal substrate, such substrate may be topcoated with a weldable primer and then, following welding, the resulting metal assembly is further topcoated. The weldable primers, and often the silicate primers, are formulated with subsequent topcoating of such primers being taken into consideration during formulation. Since at least the weldable primers typically contain an electrically conductive pigment, the topcoating may be an electrocoated primer.

The electrodeposition of film-forming materials is well known and can include electrocoating of simply a film-forming material in a bath where such a bath may contain one or more pigments, metallic particles, drying oils, dyes, extenders and the like. Representative film-forming systems of this nature are set forth, for example, in U.S. Pat. Nos. 3,304,250 and 3,455,805. Also, substances of particular interest, for example in the automotive industry, are the anodically deposited film-forming materials as exemplified in U.S. Pat. No. 3,230,162. Included in these composite coating systems there can be an electrophoretically deposited zinc paint. Such may be deposited, for example, on the pre-paint treated metal surface of the present invention and the deposited zinc paint provides intermediate coating for subsequent topcoating. In U.S. Pat. No. 3,464,906 a zinc paint that can be electrodeposited and contains water-soluble or dispersible resin as a binder in aqueous medium, is taught.

Reference has been made hereinbefore to welding and specifically to arc-welding. So long as the metal substrate is weldable, the pre-paint coating composition can be adapted to provide continued weldability in addition to corrosion resistance for the metal substrate. Thus a pre-paint coating composition of the present invention but formulated under considerations presented in U.S. Pat. No. 3,687,738 will provide for retention of weldability of the substrate. Furthermore, when reference is made herein to welding, the subsequent welding under consideration may be electrical resistance welding and such may be spot welding, i.e. localized electrical resistance welding, or seam welding such as with roller electrodes.

Before application of the pre-paint coating composition to a metal substrate it is generally advisable to remove foreign matter from the metal surface by thoroughly cleaning and degreasing. Degreasing can be accomplished with known agents such as sodium metasilicate, caustic soda, carbon tetrachloride, trichlorethylene and the like. The use of commercial alkaline cleaning compositions may be employed which combine washing and mild abrasive treatment, e.g., an aqueous trisodium phosphate-sodium hydroxide cleaning solution. In addition to cleaning, the substrate can undergo cleaning plus etching, for example, with a strong inorganic acid etching agent.

The following examples show ways in which the invention has been practiced but should not be construed as limiting the invention. In the examples, the following procedures have been employed.

PREPARATION OF TEST PANELS

Steel test panels, typically 4 × 8 inches, and all being cold rolled, low carbon steel panels are prepared for coating by first scrubbing with a cleaning pad which is a porous, fibrous pad of synthetic fiber impregnated with an abrasive. Thereafter, the scrubbed panels are immersed in a cleaning solution typically containing chlorinated hydrocarbon and maintained at about 180° F., or containing 1–5 ounces, per gallon of water, of a mixture of 25 weight percent tripotassium phosphate and 75 weight percent potassium hydroxide. This alkaline bath is maintained at a temperature of about 150°–180° F. Following the cleaning, the panels are rinsed with warm water and preferably dried.

PRE-PAINT COATING COMPOSITION AND APPLICATION

There is separately prepared a precursor constituent by blending into 500 mls. of water 20 grams of chromic acid, 3.33 grams of succinic acid, and 1.67 grams of succinimide. When this precursor constituent has a pH of about 0.8 or less, as detailed in the examples, it is used as a control; and, when the pH is adjusted above 0.8 with the addition of a pH adjustment agent, as will be detailed in the examples, such resulting adjusted constituent will be representative of the present invention. Regardless, the resulting constituent is then blended with the other pre-paint composition ingredients as detailed hereinbelow to form a pre-paint composition containing 150 grams per liter of zinc dust. Clean test panels are dip coated into this pre-paint composition, removed and excess composition is drained from the panels, and then baked for 4.5 minutes in an oven at a temperature of 550° F.

The other composition ingredients are 500 milliliters (ml.) of water, 1.5 grams of heteropolysaccharide dispersing agent, 1 ml. of formalin, and one drop of a wetter which is a nonionic, modified polyethoxide adduct having a viscosity in centipoises at 25° C. of 180 and a density at 25° C. of 8.7 lbs. per gallon. These ingredients also include zinc dust. Unless otherwise noted, this is an "L-15" dust manufactured by American Smelting and Refining Co. The zinc dust has an average particle size of about 5.1–5.3 microns, with about 7–11% of the particles having size greater than 10 microns; further, this zinc dust has about 5–8 weight percent of the particles finer than 2 microns.

PRIMER TOPCOATING AND APPLICATION

When pre-painted panels are primer topcoated, the primer, initially, is a commercially available primer which is a zinc-rich weldable primer having at first a weight per gallon of 15.4 lbs., an initial solids volume of 30%, and containing initially 64 weight percent of nonvolatiles. The binder component is prepared from a high molecular weight epoxy resin. Prior to use, this primer is reduced to viscosity of 45 seconds as measured on a No. 4 Ford cup with an aromatic solvent prepared synthetically from petroleum and having a flash point of 145°–150° F. This primer is applied to all of the pre-painted panels by drawing the primer down over the panel with a draw bar to provide a smooth, uniform primer coat on each of the pre-painted panels.

Resulting coated panels are cured for 4 minutes in an oven at 550° F.

DRAW TEST (SHEAR ADHESION)

The adhesion of the coating system on the panel under shearing force is then measured in the draw test. In this test the panel is first oiled on both sides of the panel with a light oil. The panel is then drawn through the draw test; next it is pressed to return the panel to its original shape, and finally the panel, without further oiling, is subjected again to the draw test. After removal from the second draw, the panel is wiped clean and is then visually inspected to determine the percentage of the exposed bare metal, or alternatively, of the coating system retained on the panel.

In this inspection, panels are compared one with the other, and the percent retention is generally estimated simply after visual inspection, although, the panels may be subsequently soaked for 10 seconds in copper sulphate solution, containing 160 grams of copper sulphate per liter of water. This facilitates the visual determination of what percentage of the panel is left uncovered owing to the copper sulphate plating on the base steel, but not on burnished zinc. That is, the copper from the copper sulphate will not plate on the coating where the zinc has been polished by scraping but not removed to bare steel. The passage of the panel twice through the draw test is found from experience to better correlate results for coating adhesion under shear force with such results as would be observed in industry. For example, in the automotive industry as has been mentioned hereinbefore, primer coated panels often proceed through as many as five or more operations, including drawing, pressing, trimming, punching and bending.

In the draw test, more specifically, there is used a Tinius Olsen Ductomatic Sheet Metal Tester, Model BP-612N. This machine is commonly used in the steel industry for determining the ductility of steel panels. In general, an about 1.75 × 12 inch steel panel is held firmly between male and female dies, each having a central aperture, to permit a metal ram to move upwardly through the dies for a pre-selected distance. The ram forces the panel upwardly in the aperture of the male die, resulting in the pulling and stretching of part of the panel through a portion of the mating surface of the dies. More particularly, the female die, measuring approximately 3.5 inches × 6 inches × 0.75 inch is placed so that its central aperture of about 2 × 1 inch, is located directly over the ram.

The panel for testing is then placed flat across the female die so that a portion of the panel projects out from one die edge. The male die, of essentially similar dimensions to the female die, is then placed on top of the test panel; its central aperture is positioned over the metal ram. The female die on its upper surface contains two projecting ridges across the width of the die, one on each side of the aperture and having an inverse U-shape. The lower face of the male die is machined to have two U-shaped grooves, each about 0.25 inch deep, one on each side of the aperture, and across the width of the undersurface. The ridges provide a snug fit into the corresponding grooves, thereby enhancing the firm grip for the dies on the test panel. Also, one groove/ridge configuration provides two bearing, i.e. scraping, surfaces during the test, as discussed further hereinbelow.

At each corner, the female die has a pin extending upwardly for mating with a corresponding aperture in the male die. These pins are for maintaining stability of the dies during the test and are not in contact with the test panel. After the male die is in place, a hinged breach is pulled down on top of the male die and locked. The portion of the test panel projecting out from the dies is clamped. By such action, the clamping of approximately one-half of the panel is more firmly established; thus, during testing only about the other half of the panel will be free to move and be drawn during the test. After clamping, the instrument clamp load is set at 3,000 lbs., the rate of draw dial provided on the instrument is set at 10, and the ram is permitted to move upwardly for a distance of about 2.5 inches. During this movement, about the first half-inch of ram movement is necessitated to move the rounded-dome ram into contact with the panel and the remaining about 2 inches of movement actually draws half of the panel through the mated die surfaces.

In typical operation for an .036-inch steel, the ram is moved upwardly at a force of about 2,500–4,000 lbs. The half-portion of the panel tested is drawn across three bearing surfaces. Two of these are provided by the edges of the groove in the groove/ridge configurations. The third bearing surface is the edge of the male aperture parallel and closest to the groove providing the other two bearing surfaces. The panel portion thus actually subjected to the test typically measures about 1¾ × 2.5 inches. With the above mentioned .036-inch steel, this section will often exhibit an about 20–25% total metal extension, beyond its original test length, after the second draw. After such draw, the general configuration of the panel shows a U-shaped central portion that has been pushed upwardly about 2 inches from the original flat surface.

CORROSION RESISTANCE TEST

Panels are subjected to the corrosion resistance test by means of the standard salt spray (fog) test for paint and varnishes as described in ASTM B-117-64. In this test, panels are placed in a chamber held at constant temperature where they are exposed to a fine spray (fog) of a 5% salt solution for a period of time as noted in the examples. Upon removal from the chamber the panels are rinsed in water and then dried. The extent of corrosion, i.e., red rust, on the test panels is determined by visual inspection through comparison of panels one with the other.

EXAMPLE 1

Pre-paint coating compositions are prepared as described above; the control precursor constituent has a pH of 0.7. The precursor constituent representative of the present invention is adjusted to a pH of 1.3 by the addition of 14 grams per liter of such constituent of zinc oxide. Resulting pre-paint coating compositions all contain 150 g./1. of the hereinabove described zinc, which contains 2.9% oxide. Compositions from both the "Control" constituent and "Adjusted" constituent have a total bath pH as shown in the table below. Coated panels, prepared as above described, have coating weights for both the chromium and the zinc as shown in the table below.

Some panels are bent (formed) and are then subjected to the above described corrosion resistance (salt spray) test for a time of 136 hours. Other panels are topcoated with the topcoat primer as above discussed.

Some of these panels are bent and are selected for salt spray testing and others that are unformed are selected for draw testing. Results of all such tests are presented in the table below, except for corrosion of panels at the bend. The results for the bend highlight the superiority of the coating obtained from the adjusted constituent of the present invention, but somewhat parallel the results reported for corrosion on the face of the panels.

Resulting pre-paint coated panels are topcoated with a topcoat primer, and in manner as above discussed. Representative panels having the pre-paint coating from the Control precursor constituent exhibit a coating weight for the chromium of 22 milligrams per square foot (mg./sq.ft.) and for the zinc of 120 mg./sq. ft. Representative panels from the pre-paint composition prepared from the Adjusted constituent have coating weights of 42 mg./sq. ft. for the chromium and 640 mg/.sq. ft. for the zinc. Nevertheless, despite these higher prepaint coating weights, such panels, that are topcoated prior to testing, exhibit 100% coating retention in the drawn adhesion test. The representative panels for the Control, which panels are topcoated, average, for two panels, only 60% retention in the draw adhesion test.

TABLE 1

| Pre-Paint Composition | Precursor pH | Pre-Paint Composition pH | Pre-Paint Coating Weight* Cr | Pre-Paint Coating Weight* Zinc | Double Draw % Coating Retained | Salt Spray % Corrosion Pre-Painted | Salt Spray % Corrosion Topcoated |
|---|---|---|---|---|---|---|---|
| Control | 0.7 | 3.9 | 31 | 340 | 26 | 7 | 1 |
| Adjusted | 1.3 | 5.5 | 32 | 390 | 99 | 3 | 0 |

*In milligrams per square foot.

It will be noted that the coating from the Adjusted constituent yields a greater pre-paint coating composition weight. This is slight for the chromium, and moderate for the zinc; the corrosion resistance is definitely enhanced. But the draw results are excellent for this adjusted precursor constituent. This result is obtained even though the coating weight for the pre-paint coating composition is comparatively greater.

EXAMPLE 2

Pre-paint coating compositions are prepared as described above and an "Adjusted" precursor constituent representative of the present invention is adjusted to a pH of about 1.3 by the addition of zinc oxide at the rate of 14 grams per liter. Resulting pre-paint coating compositions are prepared from both this resulting "Adjusted" constituent and an unadjusted, that is "Control" constituent, and each have 150 grams per liter of particulate zinc. However, for this example, the particulate zinc has an average particle size of 3.2 microns, with one weight percent having size greater than 10 microns and all particles finer than 13 microns; this particulate zinc further has 17 weight percent of the particles finer than 2 microns and an oxide content of 3.6%. This zinc is obtained as the fine fraction from classification of the above described commercial L-15 zinc powder. This fine fraction is obtained by classification in a Donaldson particle classifier manufactured by the Donaldson Company, Inc., Corad division.

In essence, the commercially available L-15 zinc dust is automatically fed into a rotating chamber while three variables, i.e., airflow, rotor speed and vortex freedom, are adjusted. In this way, the classifier, which is more specifically described in U.S. Pat. No. 3,491,879, controls the drag and centrifugal force on the inflow of particles. By this operation, the fine fraction is obtained from the vortex of the rotor apparatus while the separated, coarse zinc particle fraction is removed at the periphery of such apparatus. Pre-painted panels are then prepared also as above described.

EXAMPLE 3

Pre-paint coating compositions are prepared as described above. In this preparation, various precursor constituents are used. Two of these are control constituents such as have been discussed hereinbefore; an additional constituent has an adjusted pH of 1.75 by the addition of 16 grams per liter of precursor of zinc oxide; and the last has an adjusted pH of 3.5 by the addition of 18 grams per liter of precursor of zinc oxide. One of the control precursor constituents is used in the manner described above to prepare a pre-paint coating composition containing 150 grams per liter of zinc dust. However, in this case the zinc dust has an average particle size of 2.75 microns and a zinc oxide content of about 7 percent.

Another control precursor constituent is used to prepare a pre-paint coating composition in the above discussed manner, and to contain 150 grams per liter of zinc dust. However, the zinc dust used has an average particle size of 3.5 microns and a zinc oxide content of about 7.55 percent. The adjusted constituent having a pH of 1.75 is used in the manner described above, with the above mentioned commercial L-15 zinc dust, to form a pre-paint coating composition containing 150 grams per liter of such zinc dust.

The adjusted constituent having a pH of 3.5 is used in the manner above described to form a pre-paint coating composition. This last coating composition however, contains only 100 grams per liter of the L-15 zinc dust. The pH for all of these freshly prepared coating compositions is then measured and is found to range only between 4.6–4.9 as shown in Table 2 below. Bath stability as determined by gelation, is also shown in the table.

TABLE 2

| Pre-Paint Composition | Zinc Dust % Oxide | Zinc Dust Conc., g./l. | Precursor pH | Pre-Paint Composition pH | Pre-Paint Composition Gelation |
|---|---|---|---|---|---|
| Control | 7 | 150 | 0.6 | 4.6 | 7 hrs. |
| Control | 7.55 | 150 | 0.6 | 4.7 | 6 hrs. |
| Adjusted | 2.9 | 150 | 1.75 | 4.8 | <3 days |

TABLE 2-continued

| Pre-Paint Composition | Zinc Dust % Oxide | Zinc Dust Conc., g./l. | Precursor pH | Pre-Paint Composition pH | Pre-Paint Composition Gelation |
|---|---|---|---|---|---|
| Adjusted | 2.9 | 100 | 3.50 | 4.9 | >3 days |

As shown in the table, three days after preparation, one of the baths prepared from an adjusted constituent has finally gelled. Even at this time, the other bath from the adjusted constituent has not as yet gelled. These results demonstrate the highly desirable stability of such baths as are formed when the precursor constituent is adjusted. This desirable stability is exhibited even among baths where the final bath pH is essentially similar.

EXAMPLE 4

Pre-paint coating compositions are prepared as described above. In formulating these compositions two separate precursor constituents are used; in one of these constituents the pH is adjusted to 1.5 by the use of sodium hydroxide. In the other precursor constituent the pH is likewise adjusted to 1.5, but with the use of potassium hydroxide. Panels are coated with the resultant pre-paint coating compositions, prepared as above described and cures of resulting coated panels, as above described are attempted.

However, after baking for 4.5 minutes at an oven temperature of 550° F, and subsequent water quenching, the coatings have not achieved a cure. This is readily observed by the yellow color of the quench water, denoting water soluble chromium substance in the water, as well as by observation of the bright steel panel surface where coating removal is complete or essentially complete. Such panels are therefore prepared for comparative purposes only.

An additional precursor constituent is prepared as described heretofore and an attempt is made to adjust the pH of the precursor constituent to 1.5 by the addition of aluminum hydroxide. During this attempt at pH adjustment, it is observed that the aluminum hydroxide will not dissolve into the precursor constituent, even with vigorous agitation. In view of this inability to form a solution, the aluminum hydroxide is unable to adjust the pH of the constituent. Such insoluble hydroxide is therefore not regarded as a compatible pH adjusting agent and such exemplary showing is presented here for comparative purposes only.

Additional precursor constituents prepared as above described are used for further testing. With one of these constituents the pH is adjusted to 1.5 with calcium oxide. With another constituent the pH is adjusted to 1.5 with magnesium oxide. Pre-paint coating compositions are prepared as described above from these adjusted precursor constituents. Coated panels, also prepared as above discussed, are prepared from these coating compositions and the coatings on these panels are successfully cured, also in the manner hereinbefore discussed.

Panels prepared from these coating compositions are found to exhibit water insoluble coatings as demonstrated by the abovee mentioned water quenching. Both the calcium oxide and the magnesium oxide are therefor considered to be compatible pH adjusting agents that are suitable for use in the present invention.

EXAMPLE 5

In this example, strontium oxide is used and exhibits desirable characteristics of a compatible pH adjusting agent. Thus the strontium oxide is regarded as a suitable pH adjusting agent even though such oxide is not readily soluble in a precursor constituent although it has sufficient solubility for desirable pH adjustment. Moreover, strontium oxide exhibits some reducing activity towards the hexavalent chromium in the precursor constituent. However, such hexavalent chromium reduction is only minor in nature and sufficient hexavalent chromium can be readily provided in the resulting, adjusted, precursor constituent to later achieve desirable coatings.

A precursor constituent prepared as above described is blended with 6 grams of strontium oxide and by visual observation it can be seen that the strontium oxide dissolves very slowly. This is further accompanied by some reduction of the hexavalent chromium that can be visually observed by a gradual darkening of the solution. Subsequently an additional four grams of strontium oxide is added and the resulting admix is blended for 15 minutes. The resulting pH of the precursor constituent is thereby adjusted to 1.3. As all of the strontium oxide can be seen by visual observation to have not yet dissolved, the solution is filtered and the subsequent fitrate is used in the manner above described to prepare a pre-paint coating composition.

Panels are subsequently coated with the resulting pre-paint coating composition and the coated panels are cured, all in the matter discussed hereinabove. Resulting coated panels are viewed to have a water insoluble coating. Resulting coated and formed panels are subjected to the above described corrosion resistance test. After 60 hours of such salt spray testing, the coated panels are seen by visual inspection to be free from red rust. Other unformed panels are topcoated with the topcoat primer as above discussed. These panels are subjected to draw testing; the results of such draw testing show 100% of the coating retained during the test. All of these results thus indicate that strontium oxide is a compatible pH adjusting agent, although it is not readily soluble, and even though it exhibits some ability to reduce the hexavalent chromium during the adjustment of the precursor constituent.

EXAMPLE 6

Pre-paint coating compositions are prepared as described above. In formulating these compositions, several separate precursor constituents are used; in one of these constituents the pH is adjusted to 1.52 by the use of ammonium hydroxide, and in another to 1.55 by the use of zinc oxide. In another precursor constituent the pH is adjusted to 5.0 with the use of ammonium hydroxide, and in yet another to 5.0 by zinc oxide. One constituent is left unadjusted at a pH of 0.5. All constituents are used to prepare pre-paint coating compositions and thereafter pH determinations of each composition are made with the results being shown in the Table 3 below.

The coating composition made with the precursor constituent of unadjusted pH, subsequently has its pH adjusted to 6.0 by the addition of ammonium hydroxide. However, the bath immediately agglomerates and gells, although it has not been adjusted to a pH beyond the range of the other baths. This result further demonstrates the highly desirable stability achieved by coating compositions that are formed only after the precursor constituent is adjusted. This desirable stability is so necessary to achieve through precursor pH adjustment, that it is exhibited even with an adjustment agent that is not considered to be compatible.

Panels are coated with the baths that have not gelled and in the manner above described; after curing, the coatings from the baths containing the ammonium hydroxide are observed to not have achieved a cured coating. This is readily observed by gross coating removal from adhesion failure in impact testing, which failure is known to correlate in direct relationship with water solubility for such coatings. Such panels are as made up from the ammonium-hydroxide-containing baths are therefore prepared for comparative purposes only.

Representative pre-paint coated panels are topcoated with a topcoat primer, and in manner as above discussed. Resulting panels are then subjected to the draw adhesion test, with the results being reported in Table 3.

TABLE 3

| Precursor pH Adjustment Agent | Precursor pH | Pre-Paint Composition pH | Double Draw % Coating Retained |
|---|---|---|---|
| Ammonium Hydroxide | 1.55 | 5.15 | 0 |
| Ammonium Hydroxide | 5.0 | 6.0 | 10 |
| Zinc Oxide | 1.52 | 4.9 | 92 |
| Zinc Oxide | 5.0 | 5.7 | 96 |

From such results it is clear that the ammonium hydroxide can not provide the compatibility necessary for the pH adjustment agent.

Additional precursor constituents prepared as above described are used for further testing. With one of these constituents the pH is adjusted to 1.1 with calcium carbonate. A pre-paint coating composition is prepared in the manner described above from the adjusted precursor constituent. Coated panels, also prepared in the manner above discussed, are coated from these coating compositions and the coatings on these panels are successfully cured, also in the manner hereinbefore discussed. These coatings are found to achieve desirable results upon subjecting such panels to coating adhesion and corrosion resistance testing. In similar manner, zinc carbonate has also been found to provide highly satisfactory results. Both the calcium carbonate and the zinc carbonate are therefor considered to be compatible pH adjusting agents that are suitable for use in the present invention.

Further, precursor constituents prepared as above described are used for additional testing. One of these constituents has the pH adjusted to 1.1 with zinc oxide. A pre-paint coating composition is then formulated, in the above-described manner, from the adjusted precursor constituent. In this preparation there is used 120 grams per liter of zinc dust that is 3 weight percent zinc oxide. The freshly prepared coating composition is found to have a pH of 4.2. On standing, the bath is found to be free from deleterious, irreversible gelation during four days of observation and is therefore judged to be a bath of highly desirable stability.

Another of the prepared precursor constituents is adjusted to a pH of 3.0 with zinc oxide. Subsequently, a pre-paint coating composition is formulated in the manner described above from this adjusted precursor constituent. In the formulation there is used 120 grams per liter of a zinc dust that is 4.8 percent oxide. The resulting coating composition is found to have a pH of 5.65. This bath is observed, on standing, to have acceptable freedom from gelation, but not to have the most desirable stability exhibited by the previously-prepared bath having a pH of 4.2. It is thus regarded as unadvisable to reformulate such coating composition with substantially greater amounts than 120 grams per liter of the 4.8 percent oxide content zinc dust, unless a precursor constituent is used that has a pH adjusted to a level below 3.

We claim:

1. The method of preparing a pulverulent-zinc-containing coating composition, having enhanced compositional stability at a pH below about 5.7 and above 4.0, which composition is adapted for treating metal substrates and providing corrosion resistance thereto, wherein said coating composition is prepared to contain hexavalent chromium from a pulverulent-zinc-free chromic acid component (A), and to further contain zinc from a pulverulent zinc component (B), which method comprises:

1. preparing said chromic acid component (A) at a pH of above 0.8 and not above about 5 by:
   a. establishing an aqueous composition containing chromic acid in aqueous solution, said chromic acid being present in amount sufficient to provide for a pH in water of below 0.8;
   b. adjusting the pH of said aqueous composition to above 0.8 and not above about 5, with basic, compatible and acid soluble pH adjustment agent, wherein compatibility of said pH adjustment agent provides cured coatings from said coating composition of enhanced water insolubility;
2. preparing said pulverulent zinc component (B) to contain zinc in an amount sufficient to supply above about 50 grams per liter of pulverulent zinc to said coating composition; and
3. blending components together to prepare said coating composition of enhanced stability at a pH of below about 5.7 and above 4.0.

2. The method of claim 1 wherein said aqueous composition is prepared by blending with aqueous medium containing chromic acid, a pH adjustment agent selected from the group consisting of lithium oxide, lithium hydroxide, the metal oxides or hydroxides of the metals in Group IIA or groups above IIA which are soluble in aqueous chromic acid solution, the carbonates of all of the foregoing metals that have said chromic acid solubility, and mixtures thereof.

3. The method of claim 1 further characterized by preparing an aqueous composition containing reducing agent for the hexavalent chromium provided by said chromic acid, with said acid plus reducing agent being present in amount sufficient to provide for a pH in water of below 0.8.

4. The method of claim 3 characterized by establishing said aqueous composition to contain a reducing agent supplied at least in part by carboxylic acid.

5. The method of claim 4 wherein said acid is dicarboxylic acid and there is also present an additional organic substance selected from the group consisting of succinimide, acrylamide and aspartic acid.

6. The method of preparing a corrosion resistant coated metal substrate having an adherent coating from a pulverulent-zinc-containing coating composition exhibiting enhanced compositional stability at a pH below about 5.7 and above 4.0, which composition is adapted for treating metal substrates and providing corrosion resistance thereto, and is prepared to contain hexavalent chromium from a pulverulent-zinc-free chromic acid component (A), and to further contain zinc from a pulverulent zinc component (B), which method comprises:

I. formulating the coating composition of enhanced stability by:
   1. preparing said chromic acid component (A) at a pH of above 0.8 and not above about 5 by:
      a. establishing an aqueous composition containing chromic acid in aqueous solution, said chromic acid being present in amount sufficient to provide for a pH in water of below 0.8; and
      b. adjusting the pH of said aqueous composition to above 0.8 and not above about 5, with basic, compatible and acid soluble pH adjustment agent, wherein compatibility of said pH adjustment agent provides cured coatings from said coating composition of enhanced water insolubility;
   2. preparing said pulverulent zinc component (B) to contain zinc in an amount sufficient to supply above about 50 grams per liter of pulverulent zinc to said coating composition; and
   3. blending components together to prepare said coating composition of enhanced stability at a pH of below about 5.7 and above 4.0; and thereinafter II. applying the resulting coating composition to a metal substrate; and III. permitting evaporation of volatile coating substituents thereby obtaining an adherent and corrosion resistant coating on said metal substrate.

7. The method of claim 6 further characterized by preparing an aqueous composition containing reducing agent for the hexavalent chromium provided by said chromic acid, with said acid plus reducing agent being present in amount sufficient to provide for a pH in water of below 0.8.

8. The method of claim 6 wherein volatile coating substituents are at least in part volatilized by heating applied coating composition at elevated temperature.

9. The method of claim 6 further characterized by applying to the adherent coating on said substrate a paint topcoating composition containing finely divided substance, which substance retains particulate integrity in the subsequent dry paint topcoating film.

10. A chromic acid component for use in subsequently preparing a coating composition, said coating composition containing pulverulent zinc and having enhanced compositional stability at a pH below about 5.7 and above 4.0, with said component being at a pH above 0.8 and not above about 5, said component comprising aqueous medium, cromic acid, reducing agent for the hexavalent chromium provided by said chromic acid, and basic, compatible and acid soluble pH adjustment agent, said chromic acid plus reducing agent being present in amount sufficient to provide for a pH in water of below 0.8, with said compatible pH adjustment agent being present in amount sufficient to yield a component pH adjusted to above 0.8 and not above about 5, wherein compatibility of said pH adjustment agent provides adherent, cured coatings from said coating composition which are of enhanced water insolubility and wherein the use of said component to prepare a coating composition will provide a composition at a pH below about 5.7 and above 4.0.

11. The chromic acid component of claim 10 wherein said pH adjustment agent is selected from the group consisting of lithium oxide, lithium hydroxide, the metal oxides or hydroxides of the metals in Group IIA or groups above IIA which are soluble in aqueous chromic acid solution, the compatible carbonates of all of the foregoing metals that have said chromic acid solubility, and mixtures thereof.

12. The chromic acid component of claim 10 wherein said chromic acid is present in said aqueous medium in an amount between about 10–500 grams per liter and said pH adjustment agent is present in an amount sufficient to provide a constituent pH of between about 1–3.

13. The chromic acid component of claim 10 wherein said reducing agent is supplied at least in part by carboxylic acid.

14. The chromic acid component of claim 13 wherein said acid is dicarboxylic acid and there is also present an additional organic substance selected from the group consisting of succinimide, acrylamide and aspartic acid.

* * * * *